United States Patent [19]

McReynolds

[11] 4,315,646

[45] Feb. 16, 1982

[54] DOOR HOLDER FOR CONSTRUCTION VEHICLES AND THE LIKE

[75] Inventor: Charles P. McReynolds, Aurora, Ill.

[73] Assignee: Caterpillar Tractor Co., Peoria, Ill.

[21] Appl. No.: 142,933

[22] PCT Filed: Jan. 21, 1980

[86] PCT No.: PCT/US80/00054

§ 371 Date: Jan. 21, 1980

§ 102(e) Date: Jan. 21, 1980

[87] PCT Pub. No.: WO81/02179

PCT Pub. Date: Aug. 6, 1981

[51] Int. Cl.[3] ..... E05C 5/00

[52] U.S. Cl. ..... 292/68

[58] Field of Search ..... 292/246, DIG. 44, 262, 292/DIG. 15, 264, DIG. 14; 24/19; 410/11, 12, 23, 113, 35, 43, 76; 248/503, 499; 180/68.5

[56] References Cited

U.S. PATENT DOCUMENTS

| | | | |
|---|---|---|---|
| 1,183,216 | 5/1916 | MacGlasban | 292/DIG. 14 |
| 2,550,203 | 4/1951 | Robinson | 292/262 |
| 2,919,946 | 1/1960 | Miener | 292/262 X |
| 3,618,995 | 11/1971 | McLean | 292/66 |
| 4,181,334 | 1/1980 | Fusi | 292/262 X |

*Primary Examiner*—Richard E. Moore
*Attorney, Agent, or Firm*—Phillips, Moore, Weissenberger, Lempio & Majestic

[57] ABSTRACT

During operation of a construction vehicle, such as a wheel-loader, the operator may desire to open the door of the vehicle's cab for ventilation purposes. Full opening of the door may be obstructed by the deposition of a guard rail or the like, mounted on the platform of the cab, whereby the door can be only partially opened. It is thus desirable to provide a door holder which may be selectively positioned on the platform to hold the door in any desired, open position. In addition, standard latch mechanisms for holding a door of this type in its fully open position are generally mounted externally on the cab and are thus exposed to potential damage. The door holder (13) of this invention includes a latch member (14) movable between retracted and extended positions on the vehicle, and a hook (27) secured on a door (11) for engaging the latch member when the door is in open position and the latch member is in its extended position. The latch member is preferably composed of an elastomeric material to permit stretching thereof to its extended position.

9 Claims, 5 Drawing Figures

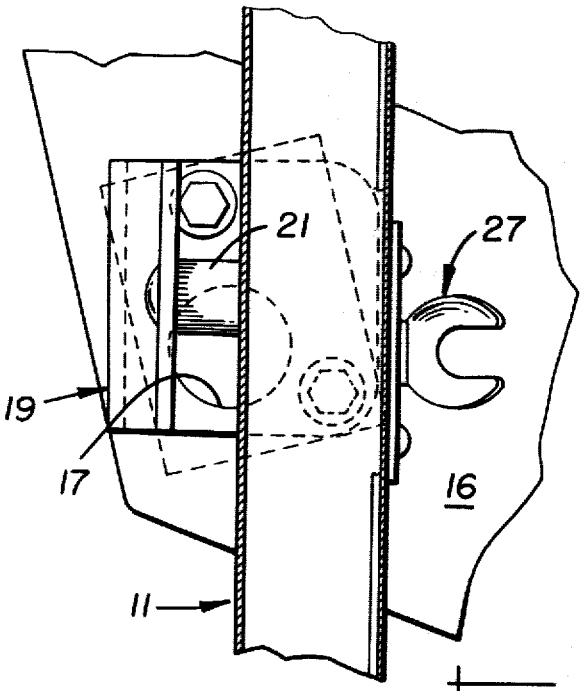
FIGURE 4
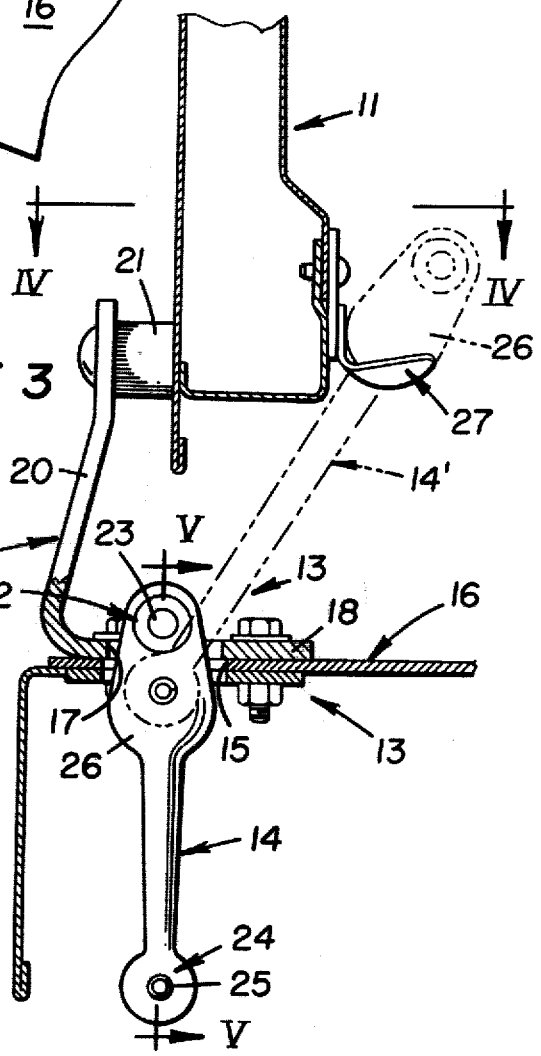
FIGURE 3
FIGURE 5
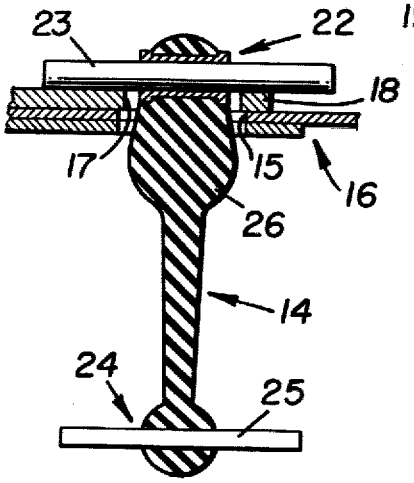

DOOR HOLDER FOR CONSTRUCTION VEHICLES AND THE LIKE

DESCRIPTION

1. Technical Field

The invention relates to a rectractable door holder for selectively holding a door in its open position.

2. Background Art

During operation of a construction vehicle such as a wheel-loader, the operator may want to at least partially open the door of the cab for ventilation purposes. It is common practice to pivot the door 180° and secure it to the cab by a standard latch mechanism. Thus, the operator is unable to only partially open the door which may prove desirable during certain operating conditions of the vehicle. In addition, conventional latch mechanisms are exposed to potential damage since they are mounted externally on the vehicle. Also, the disposition of guard rails and the like on the platform of the cab may pose an obstruction, preventing full opening of the door.

The present invention is directed to overcoming one or more of the problems as set forth above.

DISCLOSURE OF THE INVENTION

In one aspect of this invention, an improved door holder is on a vehicle for holding a door in its open position. The door holder includes latch means for moving between retracted and extended positions on the vehicle, and hook means secured on the door, for engaging the latch means when the door is in its open position and the latch means is in its extended position.

In another aspect of this invention, the latch means comprises a latch member composed of an elastomeric material, first stop means for limiting retraction of the latch member, and second stop means for limiting extension of the latch member.

The improved door holder of this invention thus provides for the holding of a door in a partially open position and is adapted to be retracted to a stored position to prevent potential damage thereto.

BRIEF DESCRIPTION OF DRAWINGS

FIG. 3 is an enlarged sectional view, generally taken in the direction of arrows III—III in FIG. 2, showing the latch member of the door holder in its retracted position by solid lines and in its extended position by phantom lines;

FIG. 4 is a top plan view of the door holder, taken in the direction of arrows IV—IV in FIG. 3; and FIG. 5 is a longitudinal sectional view through the latch member of the door holder, taken in the direction of arrows V—V in FIG. 3.

BEST MODE OF CARRYING OUT THE INVENTION

Figure 1:
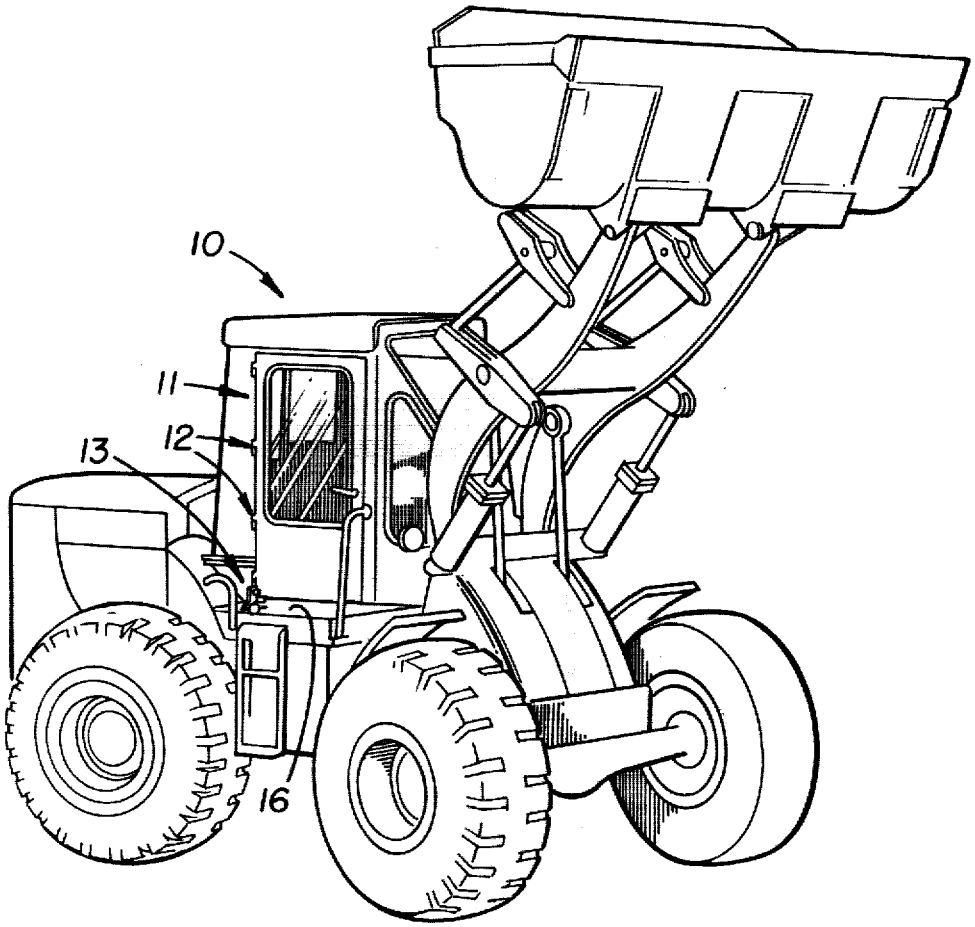
FIG. 1 is an isometric view illustrating a wheel-loader having the door holder of the present invention mounted thereon.

FIG. 1 illustrates a wheel-loader 10 having a door 11 pivotally mounted thereon by a plurality of hinges 12. This invention is directed to an improved door holder 13, mounted on the wheel-loader holding the door in a partially open position to facilitate ventilation of the operator's cab on which the door is mounted. Although door holder 13 finds particular application to construction vehicles, such as wheel-loader 10, it should be understood that it is adapted for use in many other applications wherein it is desired to hold a door in its open position.

Referring to FIGS. 2–5, door holder 13 includes a latch member 14 which is preferably composed of an elastomeric material, such as rubber stretching of the latch member thus permits extension thereof from its retracted, solid line position illustrated in FIG. 3 to its extended, phantom line position 14'. Latch member 14 is reciprocally mounted in an opening 15 formed through a platform or plate 16, disposed beneath door 11 and formed integrally with the frame of the vehicle.

Opening 15 is aligned with an opening 17, formed through a lower leg 18 of an L-shaped bracket 19. An upstanding leg 20 of bracket 19 has an elastomeric bumper 21 secured thereon to provide a stop for holding door 11 at its open position. Bracket 19 may be secured at any desired position on platform 16 to engage the door. In the example illustrated in FIG. 2, maximum opening of the door occurs through an angle of approximately 70°, relative to a side wall of the operator's cab on which the door is mounted.

A first stop means 22, shown in the form of a transversely disposed pin 23 secured on an upper end of latch member 14, functions to limit retraction of the latch member to its stored position illustrated in FIG. 3. In particular, pin 23 will engage the upper side of leg 18, as shown in FIG. 5, to maintain latch member 14 in its stored position when not used. A second stop means 24, including a transversely disposed pin 25, will permit stretching and limit extension of latch member 14 to its phantom line position 14'.

Figure 2:
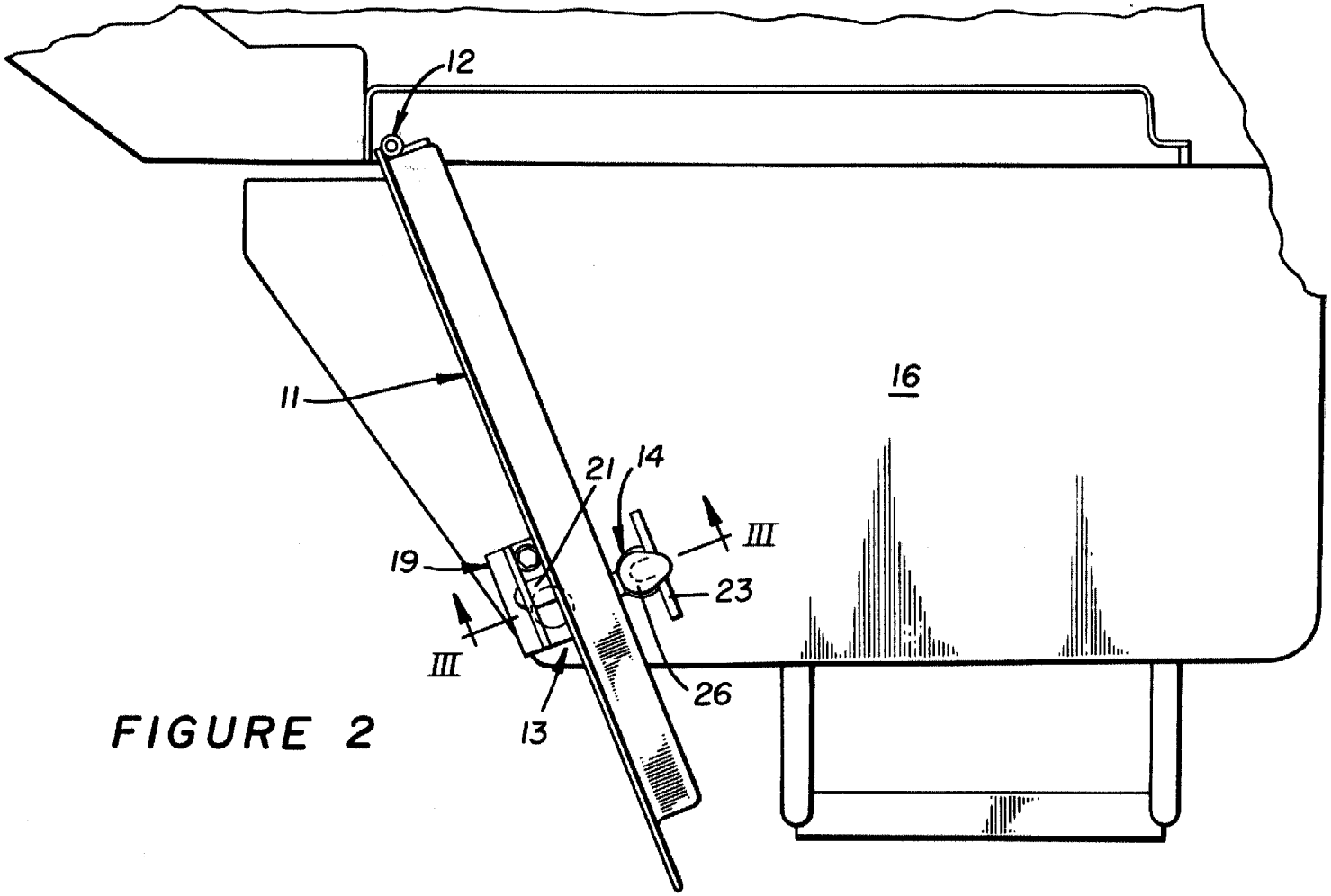
FIG. 2 is an enlarged top plan view illustrating the door holder in its operative condition of operation, holding the door in its open position.

Upon stretching of latch member 14 to its extended position 14' in FIG. 3, a bulbous end 26 of the latch member will engage within a U-shaped hook 27, secured internally on door 11, as shown in FIGS. 2–4. If so desired, a standard tension spring could be interconnected between pin 25 and a stationary panel of the vehicle to aid in retracting latch member 14 to its FIG. 3 stored position.

Industrial Applicability

Door holder 13 finds particular application to construction vehicles, such as wheel-loader 10, illustrated in FIG. 1. When the operator desires to open door 11 to its FIG. 2 position, he need only reach down and pull latch member 14 to its extended position 14' in FIG. 2 to engage the latch member over hook 27. Latch member 14 may be constructed and composed of an elastomeric material requiring a pulling force of sixty pounds, for example, to place the latch member in its latched position on hook 27.

The latch member will be held in tension to exert a pulling force on the door against rubber bumper 21 to thus dampen any vibrations which may be set up in the door during vehicle operation. Upon release of latch member 14, the latch member will fall automatically under the influence of gravity to its retracted or stored position whereby the door may be closed.

Other aspects, objects, and advantages of this invention can be obtained from the study of the drawing, the disclosure, and the appended claims.

I claim:

1. In a vehicle (10) having a door (11) pivotally mounted thereon for movement between closed and open positions, a platform (16) disposed beneath said door when said door is in its open position, and door holding means (13) for holding said door in its open position, the improvement comprising said door holding means, including latch means (14) for moving between retracted and extended positions on said vehicle and hook means (27) for releasably engaging said latch means when said door is in its open position and said latch means is in its extended position, said latch means being mounted on said platform, said hook means being secured on said door and further including an upstanding bracket (19) secured on said platform, adjacent to said latch means, having a stop (21) secured thereon to engage an external side of said door when said door is in its open position.

2. The vehicle of claim 1 wherein said platform has an opening (15) formed therethrough and wherein said latch means is reciprocally mounted in said opening.

3. The vehicle of claim 2 wherein said door holding means further includes first stop means (22) for retaining said latch member in its retracted position and second stop means (24) for limiting movement of said latch member to its extended position.

4. The vehicle of claim 5 wherein said first stop means includes a pin (23) secured on an upper end (26) of said latch member to overlie said platform when said latch member is in its retracted position and wherein said second stop means includes a pin (25) secured to a lower end of said latch member to underlie said platform when said latch member is moved to its extended position.

5. The vehicle of claim 1 wherein said latch means is composed of an elastomeric material stretchable to its extended position.

6. A door holder (13) comprising a latch member (14) composed of an elastomeric material stretchable between retracted and extended positions, first stop means (22) for limiting retraction of said latch member, including a pin (23) secured on a first end (26) of said latch member, and second stop means (24) for limiting extension of said latch member, including a pin (25) secured on a second end of said latch member.

7. The door holder of claim 6 further including a door (11) movable between closed and open positions, a hook (27) secured on said door, and a plate (16) disposed beneath said door when said door is in its open position and wherein said latch member is mounted on said plate to engage said hook in its extended position.

8. The door holder of claim 7 wherein said plate has an opening (15) formed therethrough and wherein said latch member is reciprocally mounted in said opening.

9. The door holder of claim 7 wherein said hook is secured on said door and further including an upstanding bracket (19) secured on said plate, adjacent to said latch member, having a stop (21) secured thereon to engage an external side of said door when said door is in its open position.

* * * * *